US008500095B1

(12) United States Patent
Salcedo

(10) Patent No.: US 8,500,095 B1
(45) Date of Patent: Aug. 6, 2013

(54) ELECTRIC FLOOR JACK DEVICE

(76) Inventor: Jose D. Salcedo, Lantana, FL (US)

( * ) Notice: Subject to any disclaimer, the term of this patent is extended or adjusted under 35 U.S.C. 154(b) by 112 days.

(21) Appl. No.: 13/109,236

(22) Filed: May 17, 2011

(51) Int. Cl.
*B66C 23/00* (2006.01)

(52) U.S. Cl.
USPC ..... 254/2 B; 254/DIG. 2; 254/2 C; 254/93 H; 254/101; 254/DIG. 1

(58) Field of Classification Search
USPC ..... 254/11–17, 2 B, 122–126, 133 R, 254/DIG. 2, 8 B
See application file for complete search history.

(56) References Cited

U.S. PATENT DOCUMENTS 1,652,406 A * 12/1927 Hopkins ..... 254/7 B
2,620,011 A * 12/1952 Zinke ..... 72/392
2,629,583 A * 2/1953 Mueller ..... 254/8 B
3,521,861 A * 7/1970 Freudenthal et al. ..... 254/93 L
4,314,691 A * 2/1982 Sato ..... 254/126
4,872,230 A * 10/1989 Levine ..... 7/100
6,299,138 B1 * 10/2001 Huang et al. ..... 254/126
6,357,724 B1 * 3/2002 Hung ..... 254/8 B
6,739,580 B2 5/2004 Gordon
6,910,677 B1 6/2005 Miller et al.
6,986,503 B2 * 1/2006 Arzouman ..... 254/8 B
7,431,265 B2 * 10/2008 Yueh ..... 254/8 B
7,464,914 B2 * 12/2008 Arzouman ..... 254/8 B
7,472,889 B1 1/2009 Prather
7,637,479 B2 * 12/2009 Lautzenhiser ..... 254/8 B
8,366,074 B2 * 2/2013 Lin ..... 254/8 B

* cited by examiner

*Primary Examiner* — Lee D Wilson
*Assistant Examiner* — Henry Hong

(57) ABSTRACT

The electric floor jack device provides the advantages of a typical floor jack, and more still. The device includes a frame with wheels and casters, like a typical floor jack and also lift arms and lift lever, with pivot, also like a typical floor jack, including lift block and lift pad. The handle offers an advantage not enjoyed by floor jacks known. Further advantages provided by the device include screw shaft lift of the lift arms. The screw shaft lift of the lift arms enables the use of the electric motor. Further, as opposed to the pumped vertical lift, and difficult-to-control lowering typical of most floor jacks, the screw lift provides smooth, predictable operation, whether up or down. Further, the existing removable battery pack is like many used with other currently marketed tools, and provides recharging and interchangeability advantages enjoyed by many other tools.

8 Claims, 5 Drawing Sheets

ELECTRIC FLOOR JACK DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Of the various types of jacks used in automobile lifting, the floor jack has remained the safest and most favored. The present device provides an electric floor jack device that uses an internal screw drive.

FIELD OF THE INVENTION

The electric floor jack device relates to automobile jacks and more especially to floor jacks, the present device providing an electric floor jack device with screw lift arm.

SUMMARY OF THE INVENTION

The general purpose of the electric floor jack device, described subsequently in greater detail, is to provide an electric floor jack device which has many novel features that result in an improved electric floor jack device which is not anticipated, rendered obvious, suggested, or even implied by prior art, either alone or in combination thereof.

To attain this, the electric floor jack device provides the advantages of a typical floor jack, and more still. The device includes a frame with wheels and casters, like a typical floor jack and also lift arms and lift lever, with pivot, also like a typical floor jack. The lift block and lift pad resemble those of most floor jacks. The handle offers an advantage not enjoyed by floor jacks known. Further advantages provided by the device may include screw shaft lift of the lift arms. The screw shaft lift of the lift arms enables the use of the electric motor, rather than typical manual operation as with other floor jacks. Further, as opposed to the pumped vertical lift, and difficult-to-control lowering typical of most floor jacks, the screw lift may provide smooth, predictable operation, whether up or down. Further, the existing removable battery pack is like many used with other currently marketed tools, and provides recharging and interchangeability advantages enjoyed by many other tools.

Further advantages provided by the device include up/down switch, on/off switch for conservation of battery pack power, and the important forward facing light. It is important to note that the preferred embodiment provides screw travel, but the device is offered in more typical mode of floor jacks, with electric hydraulic lift capability. The device may use any combination of mechanical and hydraulic and non-hydraulic lift means that are in communication with the lift levers.

Thus has been broadly outlined the more important features of the improved electric floor jack device so that the detailed description thereof that follows may be better understood and in order that the present contribution to the art may be better appreciated.

An object of the electric floor jack device is to a provide the advantages known to other floor jacks as well as electrical power.

Another object of the electric floor jack device is to provide smooth, predictable up and down lift block travel.

A further object of the electric floor jack device is to provide for use of a battery pack that is used with other tools.

An added object of the electric floor jack device is to provide screw lift.

And, an object of the electric floor jack device is to provide a light.

Yet another object of the electric floor jack device is to provide for battery pack power conservation.

A further object of the electric floor jack device is to provide for easy carry.

These together with additional objects, features and advantages of the improved electric floor jack device will be readily apparent to those of ordinary skill in the art upon reading the following detailed description of presently preferred, but nonetheless illustrative, embodiments of the improved electric floor jack device when taken in conjunction with the accompanying drawings.

DETAILED DESCRIPTION OF THE DRAWINGS

With reference now to the drawings, and in particular FIGS. 1 through 5 thereof, the principles and concepts of the electric floor jack device generally designated by the reference number 10 will be described.

Figure 1:
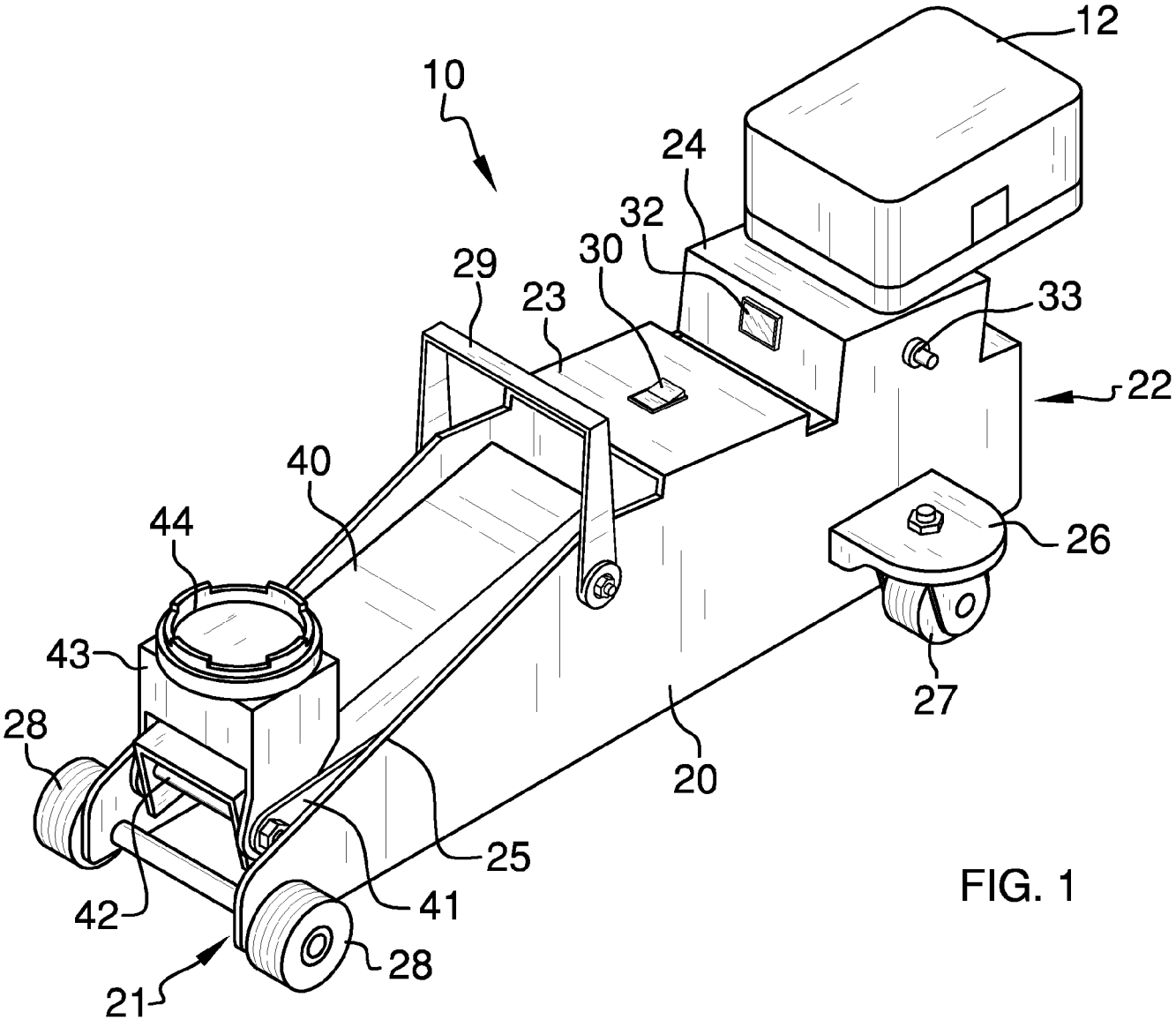
FIG. 1 is a perspective view.

Referring to FIG. 1, the device 10 partially comprises a frame 20 having a first end 21 spaced apart from a second end 22. The first platform 23 is disposed atop the frame 20 proximal to the second end 22.

The second platform 24 is disposed atop the frame 20 most proximal to the second end 22. The slant 25 is disposed atop the frame 20 and terminated downwardly on the first end 21.

Figure 3:
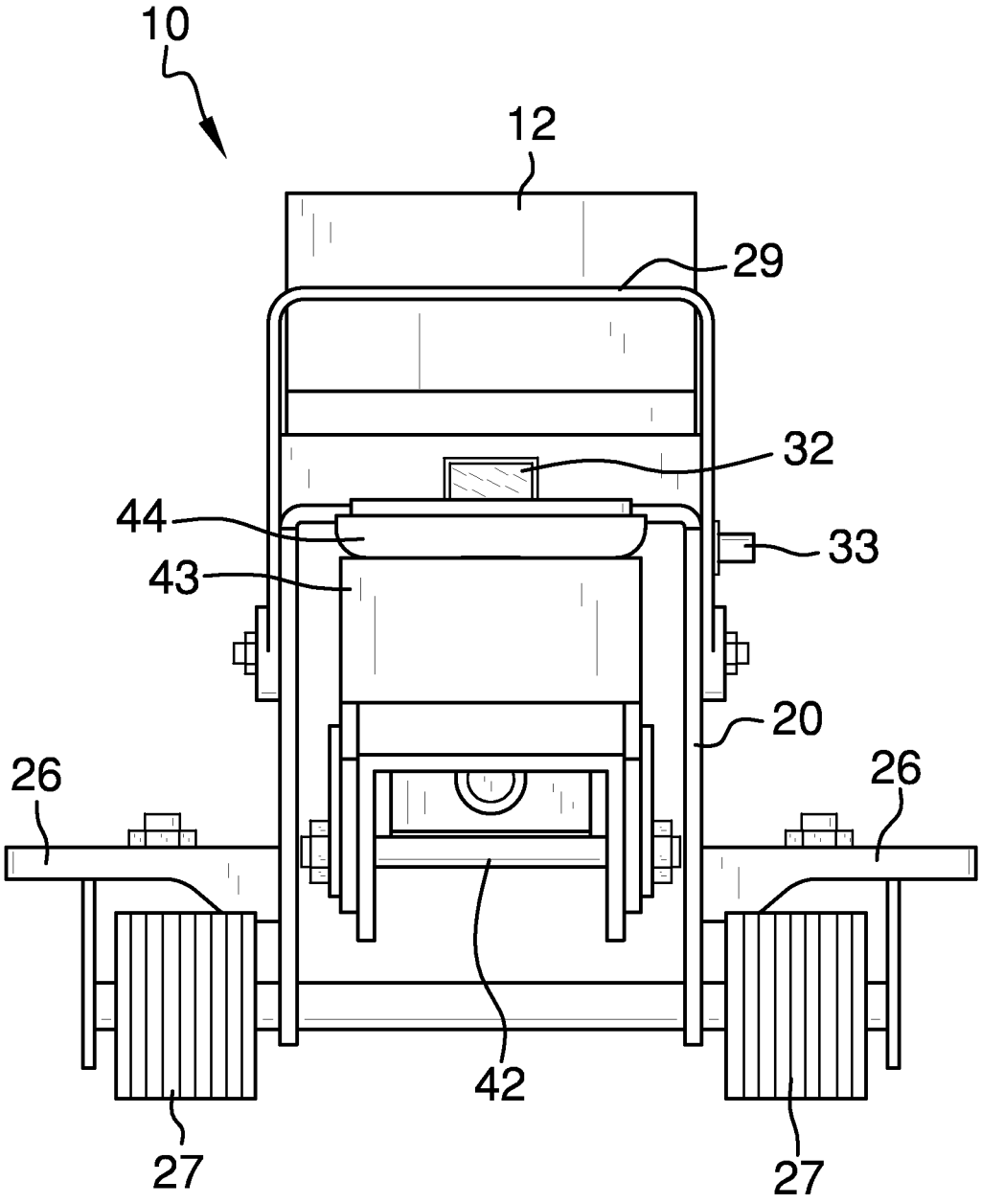
FIG. 3 is a front elevation view.

Referring to FIG. 3, a horizontally disposed ear 26 is projected from each side of the frame 20. Each ear 26 is disposed substantially downwardly most proximal to the frame 20 second end 22. A caster 27 is removably disposed on each ear 26.

Figure 2:
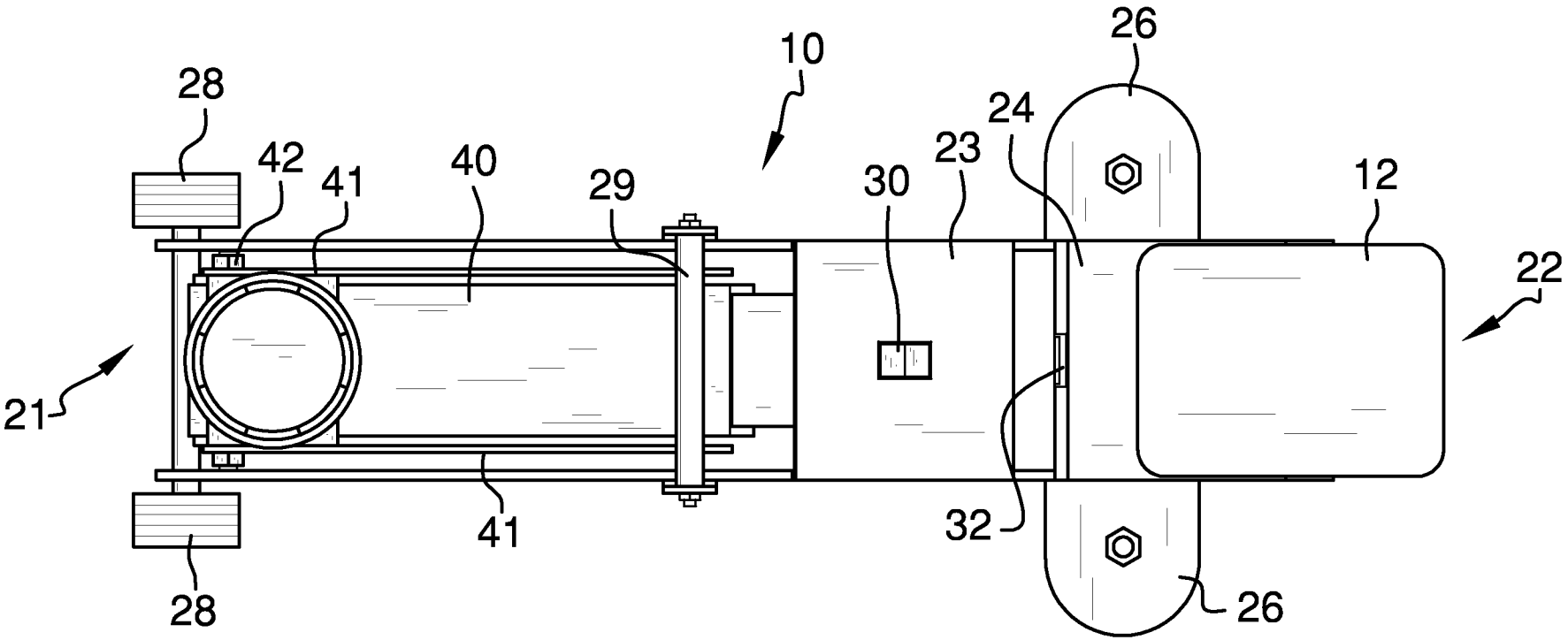
FIG. 2 is a top plan view.

Referring to FIG. 2, a front wheel 28 is disposed outwardly at the first end 21 of each side of the frame 20. The handle 29 is pivotally disposed upwardly and approximately centrally on the frame 20. The up/down switch 30 is disposed atop the first platform 23. The light 32 is disposed forwardly within the second platform 24.

Referring again to FIG. 1, the on/off switch 33 is disposed on the frame 20. The on/off switch 33 is in communication with the light 32. The lift arm 40 is pivotally disposed upwardly and forwardly within the frame 20. A pair of lift levers 41 is disposed within the frame 20 most proximally to the first end 21. Each lift lever 41 is affixed distally to and on an either side of the lift arm 40. The pivot 42 joins the lift levers 41 to the lift arm 40. The lift block 43 is affixed upwardly to the pivot 42. The lift pad 44 is removably affixed atop the lift block 43.

Figure 4:
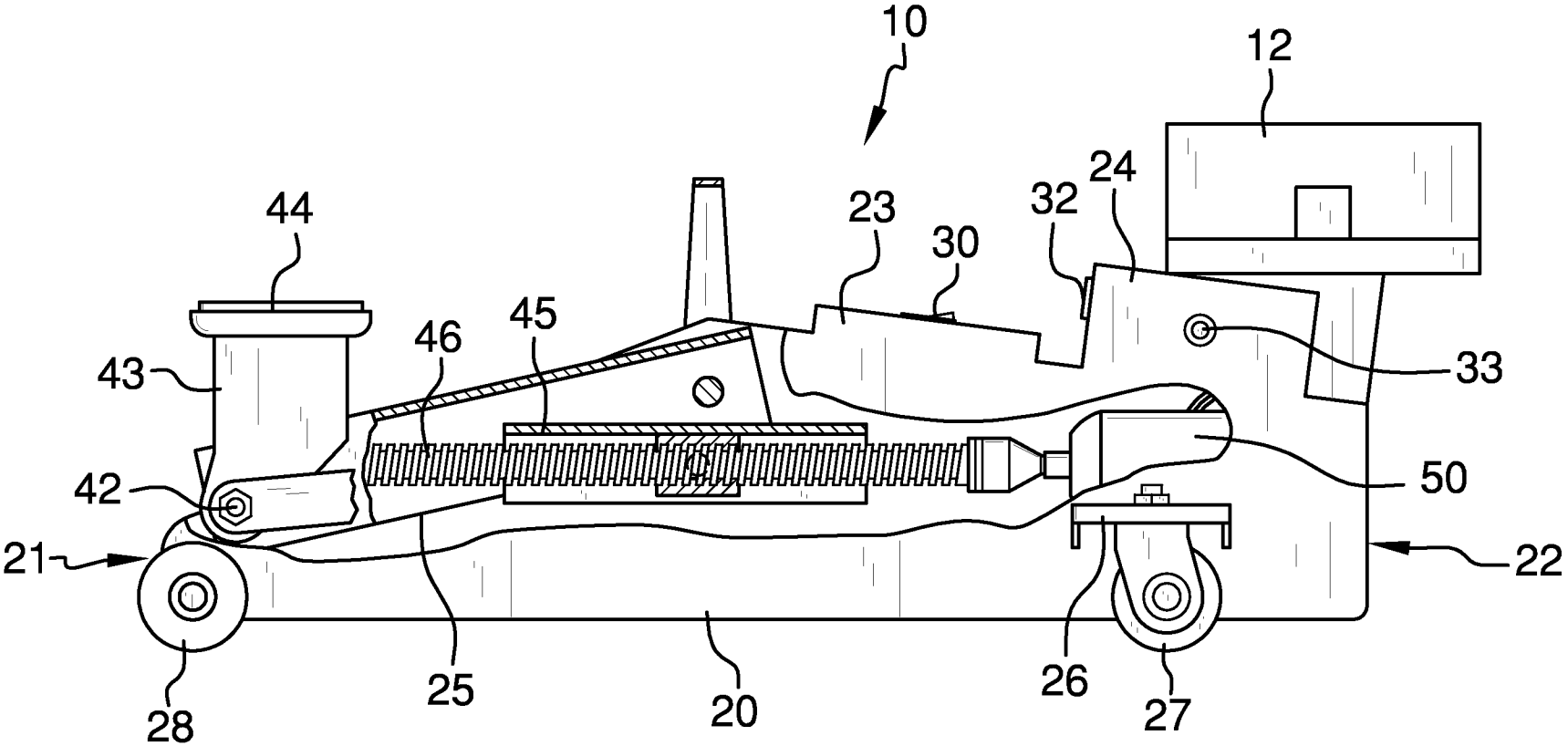
FIG. 4 is a lateral partial cross sectional view.
Figure 5:
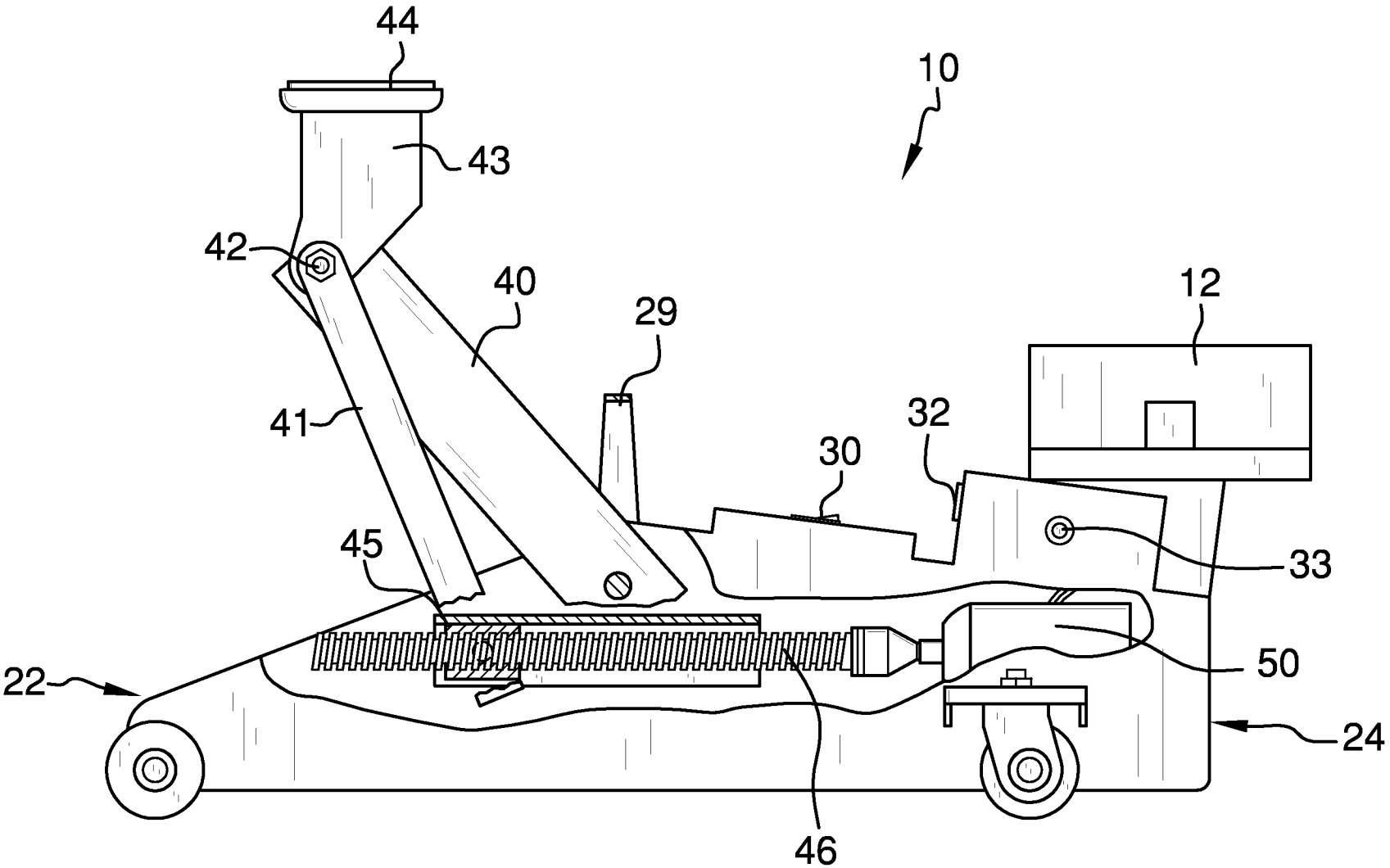
FIG. 5 is a lateral partial cross sectional view, lift block elevated.

Referring to FIG. 4, the screw sleeve 45 is disposed horizontally within the frame 20. The screw sleeve 45 is affixed downwardly to the lift lever 41. The screw shaft 46 is rotationally disposed within the screw sleeve 45. The motor 50 is disposed rearwardly within the frame 20.

The motor 50 is in communication with the screw shaft 46 and the up/down switch 30. Thereby, the lift block 43 is elevated and lowered by the up/down switch 30 via the screw shaft 46 within the screw sleeve 45.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the electric floor jack device may be used.

What is claimed is:

1. An electric floor jack device comprising, in combination:
a frame having a first end spaced apart from a second end;
a first platform disposed atop the frame proximal to the second end;
a second platform disposed atop the frame most proximal to the second end;
a slant disposed atop the frame and terminated downwardly on the first end;
a horizontally disposed ear projected from an each side of the frame, each ear disposed substantially downwardly most proximal to the frame second end;
a caster removably disposed on each ear;
a front wheel disposed outwardly at the first end of each side of the frame;
a handle pivotally disposed upwardly and approximately centrally on the frame;
an up/down switch disposed atop the first platform;
a lift arm pivotally disposed upwardly and forwardly within the frame;
a pair of lift levers, each lift lever disposed within the frame most proximally to the first end, each lift lever affixed distally to and on an either side of the lift arm;
a pivot joining the lift levers to the lift arm;
a lift block affixed to the pivot;
a lift pad affixed atop the lift block;
a motor disposed rearwardly within the frame, the motor in communication with the lift levers and the up/down switch;
whereby the lift block is elevated and lowered by the up/down switch via the lift levers.

2. The device according to claim 1 further comprising a light disposed forwardly within the second platform;
an on/off switch disposed within the frame, the on/off switch in communication with the light.

3. The device according to claim 1 wherein the lift pad is further removably affixed atop the lift block.

4. The device according to claim 1 wherein the lift pad further comprises a rubberized material.

5. The device according to claim 2 wherein the lift pad further comprises a rubberized material.

6. The device according to claim 3 wherein the lift pad further comprises a rubberized material.

7. An electric floor jack device comprising, in combination:
a frame having a first end spaced apart from a second end;
a first platform disposed atop the frame proximal to the second end;
a second platform disposed atop the frame most proximal to the second end;
a slant disposed atop the frame and terminated downwardly on the first end;
a horizontally disposed ear projected from an each side of the frame, each ear disposed substantially downwardly most proximal to the frame second end;
a caster removably disposed on each ear;
a front wheel disposed outwardly at the first end of each side of the frame;
a handle pivotally disposed upwardly and approximately centrally on the frame;
an up/down switch disposed atop the first platform;
a light disposed forwardly within the second platform;
an on/off switch disposed on the frame, the on/off switch in communication with the light;
a lift arm pivotally disposed upwardly and forwardly within the frame;
a pair of lift levers, each lift lever disposed within the frame most proximally to the first end, each lift lever affixed distally to and on an either side of the lift arm;
a pivot joining the lift levers to the lift arm;
a lift block affixed to the pivot;
a lift pad removably affixed atop the lift block;
a screw sleeve disposed horizontally within the frame, the screw sleeve affixed downwardly to the lift lever;
a screw shaft rotationally disposed within the screw sleeve;
a motor disposed rearwardly within the frame, the motor in communication with the screw shaft and the up/down switch;
whereby the lift block is elevated and lowered by the up/down switch via the screw shaft within the screw sleeve.

8. The device according to claim 7 wherein the lift pad further comprises a rubberized material.

* * * * *